United States Patent [19]

Guazzotti

[11] Patent Number: 4,721,209

[45] Date of Patent: Jan. 26, 1988

[54] FILM CARRIER CASE FOR THE EXPOSURE AND THE TREATMENT OF A RADIOGRAPHIC FILM

[75] Inventor: Livio Guazzotti, Turin, Italy

[73] Assignee: Electrochemical International Limited, Guernsey, Channel Islands

[21] Appl. No.: 22,729

[22] Filed: Mar. 6, 1987

[30] Foreign Application Priority Data

Mar. 18, 1986 [IT] Italy ..... 67212 A/86

[51] Int. Cl.[4] ..... B65D 81/32

[52] U.S. Cl. ..... 206/455; 206/219; 206/222; 206/603; 378/169; 378/183; 354/301

[58] Field of Search ..... 206/455, 219, 222, 603; 378/169, 183; 354/301

[56] References Cited

U.S. PATENT DOCUMENTS

| | | | |
|---|---|---|---|
| 3,379,879 | 4/1968 | Dicker et al. | 378/169 |
| 3,430,042 | 2/1969 | Neri | 378/169 |
| 3,443,093 | 5/1969 | Lindenmuth et al. | 206/455 X |
| 3,964,604 | 6/1976 | Prenntzell | 206/219 |

FOREIGN PATENT DOCUMENTS

| | | | |
|---|---|---|---|
| 1108781 | 4/1968 | United Kingdom | 378/183 |

*Primary Examiner*—William Price

*Attorney, Agent, or Firm*—Young & Thompson

[57] ABSTRACT

A film carrier light-proof case, whose envelope comprises a first portion enclosing a radiographic film, a second portion enclosing at least one small bag which contains chemical products in a liquid state for the development and fixing treatments of the film and means for intentionally tearing the bag, and a connection portion between these two portions of the envelope, and in which each bag comprises a first extension which starts laterally from an end of the bag, is bent along the bag and projects through the end of the second portion of the bag, and also comprises a second extension which starts centrally from the same end of the bag and extends along a part of the length of the second portion of the envelope in a direction parallel to the first extension, and the tearing means consists of an elongate member made of a stiff material, bent on itself to enclose between its own two branches the second extensions of the bags, and projecting beyond the length of the second portion of the envelope to form two tangs bent outside the two walls of the envelope.

9 Claims, 8 Drawing Figures

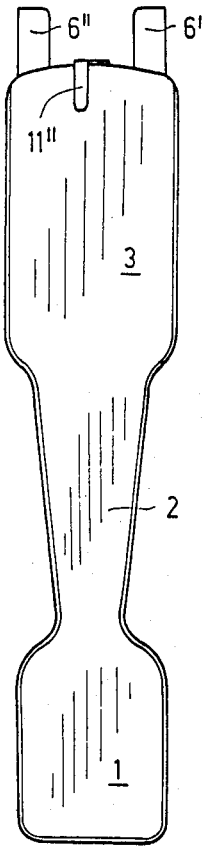
FIG. 1
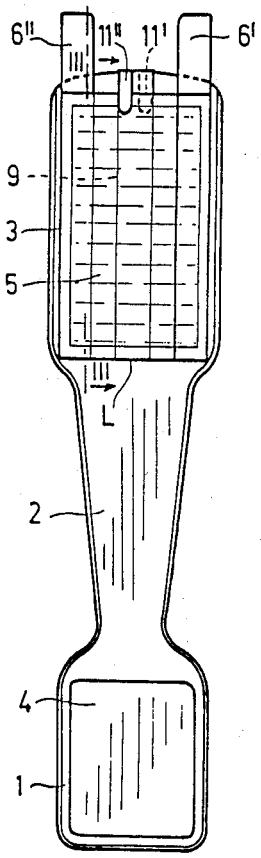
FIG. 2
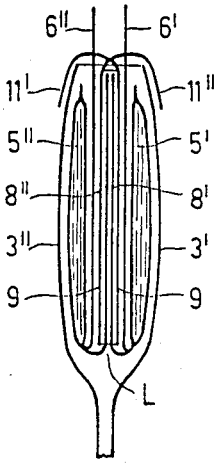
FIG. 3
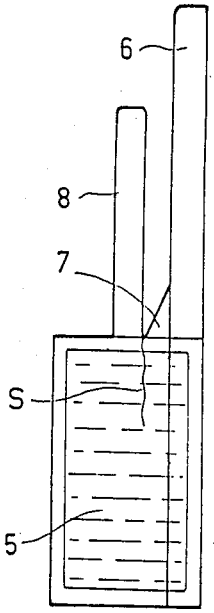
FIG. 4
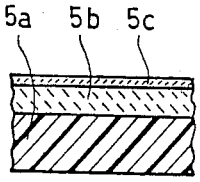
FIG. 8
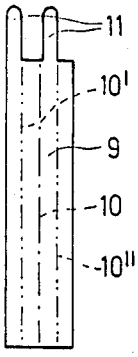
FIG. 5
FIG. 7
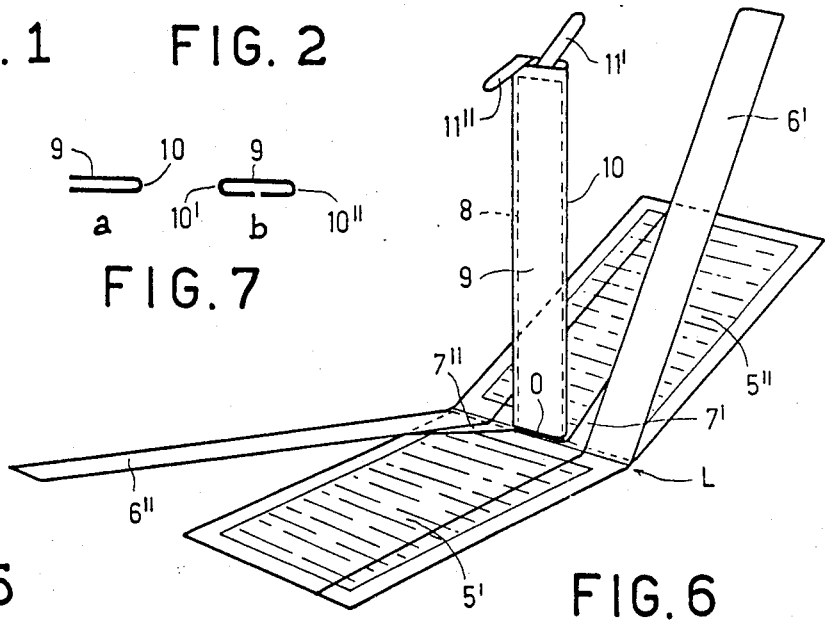
FIG. 6

FILM CARRIER CASE FOR THE EXPOSURE AND THE TREATMENT OF A RADIOGRAPHIC FILM

BACKGROUND OF THE INVENTION

This invention relates to a light-proof case, containing a radiographic film and chemical products for the development and fixing treatments thereof, intended to be used for carrying out a radiography and for successively treating the film without having to make recourse to a dark room.

Cases of the above type are known and mostly used for the endooral radiography, and they comprise an envelope subdivided into two intercommunicating portions, in one of which a radiographic film is housed, whilst the other portion encloses a single bag made of plastics and containing chemical products in a liquid state for the development-fixing treatment of the film in a monobath, or it encloses two bags containing respectively and separately the chemical production a liquid state for the development and fixing treatments of the film, as well as means for intentionally tearing said bags. A case of this type is used as a support for the film when this latter is introduced into the mouth of a patient for carrying out the radiography, and after the exposure has been accomplished and the case has been extracted from the patient's mouth, the means for tearing the single bag are activated to allow coming out from the bag the chemical products and to let them act on the film in order to carry out the development-fixing treatment, or even said means are activated for tearing the first bag in order to carry out the development treatment of the film, and then they are activated again, after a suitable period of time, for tearing the second bag in order to carry out the fixing treatment.

The main problems in this type of film carrier cases are raised by the means for tearing the bag or bags containing the chemical products. In fact, it is necessary for these means to be absolutely reliable in that they should be incapable of accidentally acting unless they are expressely activated, they should give rise, when activated, to an ample and clean tear of the bags, such as to ensure the coming out therefrom, in a very short time, of the whole quantity of the chemical products contained therein as well as an easy flow of these latter towards the film, and finally they should not introduce difficulties in the indusrial operations by which the components are mounted into the envelope. One or another of these requirements is not sufficiently complied with by the tearing means which have been proposed until now, which are in the form of pins intended to perforate the bags, of strings intended to be pulled from outside the envelope, of patterns intended to guide a tear obtained by pulling in opposite directions the two edges of the bag, or of simple stiffening means inserted into a bag to allow carrying out the tearing by a pulling action exerted onto a part of the bag itself.

BRIEF SUMMARY OF THE INVENTION

The object of the present invention is to provide a film carrier case of the above mentioned type, wherein the bags of chemcial products and the respective tearing means are improved so as to completely comply with the above requirements and, moreover, the tearing means themselves are capable of taking a useful and acitve part in the industrial operations by which the components are assembled in the envelope and fixed therein.

This object is attained, according to the invention, by a film carrier light-proof case, comprising an envelope having a first portion which encloses a radiographic film, a second portion which encloses at least one bag containing chemical products in a liquid state for the development and fixing treatments of the film as well as means for intentionally tearing said bag, and a connection portion between said two portions of the envelope, characterized in that each bag comprises a first extension which starts laterally from the bag end turned towards said connection portion, is bent along the bag and projects from the end of said second portion of the envelope, and also comprises a second extension which starts centrally from said bag end and extends along a part of the length of said second envelope portion in a direction parallel to said first extension; and that said tearing means consists of an elongate member of stiff material, bent on itself to enclose between its own branches said second extensions of all the bags, and projecting beyond the length of said second portion of the envelope to form two tangs bent outside the two walls of said envelope.

Thanks to this peculiar structure, the stiff member bent on itself may be applied by an easy operation to the second extension of the single bag or to the second extensions, disposed near one another, of all the bags, when these are more than one, and then it rigidly connects the bags to one another, thus forming with these latter a coherent assembly very easy to be introduced into the second portion of the envelope of the case, and finally, when its tangs are bent on the walls of the envelope, it provides for firmly fixing the bags of chemical products in their position and for sealing the case. Owing to its position, this stiff member can in no way accidentially produce a tearing of the bags adjacent which it is positioned. A traction applied onto the first extension of a bag gives then rise to the sharp and clean tearing of this latter, thanks to the fact that the end of the bag, near the root of the first extension which is being pulled, is retained by its second extension engaged between the branches of the stiff member bent on itself. The tearing action opens the bag at the side turned towards the connection portion which connects the two portions of the envelope, thus ensuring a prompt passage, without any hindrance, of the liquid chemical products which come out from the bag, from the second portion in which the bag is housed, towards the first portion containing the radiographic film to be treated.

BRIEF DESCRIPTION OF THE DRAWING

These and other characteristics and advantages of the subject of this invention will more clearly appear from the following description of a preferred embodiment comprising two bags of chemical products, given by way of a non limiting example and diagrammatically shown in the appended drawing, wherein:

FIG. 1 is a front view from the outside of the case according to the invention;

FIG. 2 is a view similar to that of FIG. 1, but with the front wall of the case removed in order to show the inner components;

FIG. 3 shows a cross section of the second portion of the case envelope which, for the sake of clarity of representation, is shown with exaggerated transversal distances among the components;

FIG. 4 shows a single bag in an extended condition;

FIG. 5 shows a semifinished product from which the tearing means is obtained by bending in the longitudinal direction;

FIG. 6 is a perspective view showing two bags and the tearing means which connects them to one another, in an intermediate step of the assembly operation;

FIG. 7 is an enlarged view showing two different cross sections which may be provided for the tearing means. and FIG. 8 diagrammatically shows in a fragmentary cross section and at a very enlarged scale the structure of a bag.

DETAILED DESCRIPTION OF A PREFERRED EMBODIMENT

With reference to the embodiment of a case comprising two bags of chemical products, which is diagrammatically shown in the appended drawing, the case comprises an envelope which is light-proof but is permeable to roentgen rays and is formed, in a manner per se known, by a first portion 1, a second portion 3 and a connection portion 2 which connects the portions 1 and 3 to one another. preferably, this case is formed by connecting, with marginal welding, two sheets of a suitable flexible plastics superimposed to one another, which may be formed by a single layer or else by more layers having different characteristics, coupled with one another. Between said sheets are arranged the inner components, among which there is a radiographic film 4 which is enclosed in the first portion 1 of the envelope at the time of its formation and then can be extracted therefrom only by tearing the envelope, which has to be done after the film has been exposed, developed and fixed.

Each of the bags to be housed in the second portion 3 of the case, which is the embodiment shown are in number of two, comprises in a known manner, as shown in FIG. 4, at least one bladder 5 formed by two sheets of a laminar material welded to one another along the edges, or by a sheet bent on itself and welded. In general, the laminar material forming the bags should be constituted by a plurality of layers coupled to one another, so as to comply with the different requirements which include weldability, protection against the passage of the oxygen, and mechanical resistance.

To this end, as shown in FIG. 8, the laminar material may comprise an inner layer 5A of a weldable plastics, such as polyethylene, a layer 5B capable to constitute a carrier against the oxygen, which may be of organic or inorganic nature, and an outer protection layer 5C, such as a painting or a thin sheet of paper or plastics.

Each bag contains a certain quantity of chemical products in a liquid state, and it is characterized by a first elongate extension 6 which starts laterally from one of the ends of the bag, by a second elongate extension 8 which starts centrally from the same end of the bag, and preferably also by a substantially triangular portion 7 which forms the root of the first extension 6 and terminates by defining an acute angle in the immediate vicinity of the second extension 8.

In the example shown, two such bags are provided for each case, the one of them containing the chemical products for the development of the film 4, and the other containing the chemical products for fixing the film. Both bags may be structurally identical to one another, but their identification should be made possible by marking in some way at least the ends of their first extensions; for example, the extensions themselves may be of a different colour for the two bags, or they may be countersigned by different numbers or letters, or even, preferably, they may have both these characteristics.

The tearing means is obtained from an elongate piece of stiff material 9 (FIG. 5), for example and preferably a metal sheet, by bending the same on itself along a longitudinal line 10 or along two longitudinal lines 10', 10''. At one of its ends, the tearing means 9 is provided with two tangs 11.

For carrying out their assembly, two bags 5', 5'' (FIG. 6) are disposed symmetrically relative to a point 0 situated centrally of the roots of their second extensions 8, and these latter are superimposed to one another and engaged between the branches of the tearing means 9 bent on itself. By clamping this latter, it is rigidly connected to both bags 5, which thus form with the tearing means 9 a single coherent assembly. By bending the roots of the extensions 6, 8 of the bags along line L, the two bags will rest against one another and enclose between them the respective first extensions 8 of the bags. This assembly is then introduced between the two sheets 3', 3'' which form the second portion 3 of the envelope 1–3 (FIG. 3). Finally, the tangs 11', 11'' are bent and clamped onto the walls 3', 3'' of the envelope, thus closing the formerly open end thereof and sealing the components in its interior.

Preferably, as it can be seen in FIGS. 5 and 6, the tangs 11', 11'' are obtained from two opposite branches of the tearing means 9, and the bending of the tang 11 of each branch is made towards the opposite branch of the tearing means, so that a great compactness of the sealing is obtained.

Referring now, by way of example, to the endooral use of the case, this latter is introduced with its portion 1 (containing the radiographic film 4) into the patient's mouth, whilst the second portion 3 (containing the bags with the chemical products) remains outside the mouth, and the connection portion 2 connects these portions. After the exposure has been accomplished, one pulls the first extension 6' (which projects from the end of the envelope portion 3) of the first bag 5' containing the chemical products for the development, and since the second extension 8 of this bag is engaged within the tearing means 9, the bag tears; during this operation, the presence of the root 7 of the first extension 6 of the bag localizes the stress in a well defined point in contact with the stiff tearing means 9, thus producing a sharp and clean tear along a line diagrammatically identified at S in FIG. 4. The liquid coming out from the tear passes through the connection portion 2, in the immediate vicinity of which the tear has been made, towards the first portion 1 of the envelope, where it acts onto the film contained therein, thus developing it. After the time provided for the development treatment has elapsed, the exension 6'' of the second bag 5'' containing the chemical products for the fixing is pulled, and the operations indicated above for the first bag are repeated in an identical manner for the second bag. Thus, the fixing liquid flows into the first portion 2 of the envelope and it exerts its action on the film 4 by stopping the development thereof and carrying out the fixing treatment. Finally, after the time provided for the fixing treatment has also elapsed, the envelope 1–3 may be torn (for example by pulling its walls 3', 3'' starting from the end sealed by the tangs 11', 11'') to uncover the film 4 and extract the same for examination, after having washed it in water if the case may be.

In order to form the tearing means 9, the semifinished product according to FIG. 5 may be bent on itself along the longitudinal center line 10 only, thus making it assume an U-shaped configuration, such as it is shown in FIGS. 6 and *7a*. Alternatively, the semifinished product according to FIG. 5 may also be bent on itself along two parallel lines 10', 10'', thus making it assume a closed C channel shape (FIG. *7b*). This second shape is more suitable for being used in mechanized assembly operations. However, also other shapes, technically equivalent to those described hereinabove, may be chosen.

As it can be understood, the use of the invention, on one hand, considerably facilitates the industrial operation of inserting the inner components into the envelope of the case and their fastening therein, thus advantageously acting on the industrial cost of the article, and on the other hand confers to the case the best reliability and security properties in its operation.

Although the embodiment shown comprises in the second portion of the case two bags of chemical products, it is to be understood that the scope of the invention also includes cases comprising a single bag, in view of a development-fixing treatment in a monobath, or more than two bags in order to comply with special treatment requirements. Furthermore, although there have been illustrated bags having each a single bladder containing a chemical product in a liquid state, each bag could also form two or more bladders, in order to keep separate from one another the different compenents of a product, for a better preservation thereof, said components being mixed with one another at the time of tearing the bag and its bladders.

Therefore, the treatment of the film within the case according to the invention may be of the monobath type, with products kept already mixed or kept separate from one another and mixed at the time of being used; or it may be of the two-bath type in which the products for each bath are kept already mixed or separate from one another and then mixed at the time of being used; or else a treatment with more than two baths may be used, as it may be useful for complying with special requirements, still with the eventual possibility of keeping preserved separately some of the components.

The case according to the invention is particularly suitable for the endooral radiography, but it is understood that it may be realized, generally with larger dimensions, also for any other radiography operation to be carried out in conditions in which no dark room is available or it would not be of practical use. Also with respect to this, it is to be understood that the profile given to the envelope 1–3, such as it appears from FIG. 1, does not condition the use of the invention, and that such profile could be, for example, asymmetric or proportioned in a different manner. The basic shape of the bags 5, indicated as being rectangular, could also be a different one. The tearing means 9, instead of being made of metal sheet, could be made of a rigid plastic material.

What is claimed is:

1. In a film carrier light-proof case, comprising an envelope formed by two mutually connected walls, having a first portion, a second portion and a connection portion between said first and second portions of the envelope, a radiographic film enclosed in said first portion of the envelope, at least one bag containing chemical products in a liquid state for the development and fixing treatments of a film enclosed in said second portion of the envelope, and means for intentionally tearing said bag also enclosed in said second portion of the envelope, and wherein said bag has an end turned towards said connection portion of the envelope, and said connection portion provides a passageway between said first and second portions of the envelope the improvement that each said bag has a first extension and a second extension, said first extension starts laterally from said bag end, is bent along the bag and projects from the end of said second portion of the envelope, and said second extension starts centrally from said bag end, and extends along a part of the length of said second portion of the envelope in a direction parallel to said first extension; that said tearing means comprises an elongate member made of a stiff material, which is bent on itself to form two branches, and that said tearing means encloses between said branches the second extensions of all the bags, it extends beyond the length of said second portion of the envelope and it has two tangs which are bent outside the two walls of said envelope.

2. A film carrier case as set forth in claim 1, wherein said first extension of each bag has a root portion adjacent said bag end, said root portion terminates in the vicinity of said second extension, said root portion and second extension defining between them an acute angle.

3. A film carrier case as set forth in claim 1, wherein each bag is made of a laminar material welded along its edges in order to define at least a bladder, having at least a weldable inner layer, at least an intermediate layer forming a barrier against the passage of the oxygen, and at least an outer layer for mechanical protection.

4. A film carrier case as set forth in claim 3, wherein said weldable inner layer is made of polyethylene, said intermediate layer which forms a barrier against the passage of the oxygen is made of a suitable organic or inorganic material, and said outer layer for mechanical protection is formed by a painting or a thin sheet of paper or plastics.

5. A film carrier case as set forth in claim 1, wherein said bags are in number of two, and said first extensions of both bags and the tearing means enclosing the second extensions of said bags are located between the two bags disposed the one facing the other within the second portion of the envelope.

6. A film carrier case as set forth in claim 1, wherein said tangs of the tearing means are provided one on each branch of the tearing means, and each of them is bent towards the other branch and on the adjacent wall of the envelope.

7. A film carrier case as set forth in claim 1, wherein said tearing means has a U-shaped cross-section resulting from it being bent on itself along a single center line.

8. A film carrier case as set forth in claim 1, wherein said tearing means has a closed C-shaped cross-section resulting from it being bent on itself along two parallel lines.

9. A film carrier case as set forth in claim 1, wherein said tearing means is made of a metal sheet.

* * * * *